US006457469B1

(12) United States Patent
Mueller et al.

(10) Patent No.: US 6,457,469 B1
(45) Date of Patent: Oct. 1, 2002

(54) DEVICE FOR CAM-CUTTING SLABS OR TILES

(76) Inventors: Erich Mueller, Ehrenprelsweg 7, Weingarten, D-88250 (DE); Daniel Schmid, Eichenstrasse 18, Kirchdorff/Iller, D-88457 (DE)

( * ) Notice: Subject to any disclaimer, the term of this patent is extended or adjusted under 35 U.S.C. 154(b) by 0 days.

(21) Appl. No.: 09/889,928

(22) PCT Filed: Jan. 12, 2000

(86) PCT No.: PCT/DE00/00078

§ 371 (c)(1),
(2), (4) Date: Nov. 13, 2001

(87) PCT Pub. No.: WO00/43181

PCT Pub. Date: Jul. 27, 2000

(30) Foreign Application Priority Data

Jan. 25, 1999 (DE) ..... 199 02 860
Mar. 6, 1999 (DE) ..... 199 09 976

(51) Int. Cl.[7] ..... B28D 1/32

(52) U.S. Cl. ..... 125/23.01; 125/23.02; 83/886; 225/96.5; 225/96

(58) Field of Search ..... 125/23.01, 23.02; 83/881, 886; 225/96, 96.5, 104

(56) References Cited

U.S. PATENT DOCUMENTS

| | | | |
|---|---|---|---|
| 1,511,016 A | | 10/1924 | Barker |
| 1,680,805 A | | 8/1928 | Schmidt |
| 3,104,467 A | | 9/1963 | Lloyd-Young |
| 4,382,590 A | | 5/1983 | Pandya et al. |
| 5,626,124 A | | 5/1997 | Chen |
| 6,269,994 B1 | * | 8/2001 | Harrington |

FOREIGN PATENT DOCUMENTS

| | | |
|---|---|---|
| DE | 12 40 241 | 7/1961 |
| DE | 296 00 050 U1 | 4/1996 |

* cited by examiner

*Primary Examiner*—Joseph J. Hail, III
*Assistant Examiner*—Willie Berry, Jr.
(74) *Attorney, Agent, or Firm*—Crowing & Moring LLP

(57) ABSTRACT

The invention relates to a device for cutting slabs or tiles, comprising a frame which has a support surface for the slabs or tiles and a cutting mechanism which is displaceably mounted on the frame, above the support surface, in order to produce a point of break in the surface of the slab or tile. According to the invention, guiding elements are provided for guiding the cutting mechanism along a curved path while it is displaced on the frame.

21 Claims, 5 Drawing Sheets

DEVICE FOR CAM-CUTTING SLABS OR TILES

The invention relates to a device for cutting slabs or tiles and, more particularly, to a device with a frame, which has a bearing surface for the slabs or tiles, and a cutting member for creating a rupture location in the slab or tile surface, which member is mounted on the frame displaceably over the bearing surface.

BACKGROUND OF THE INVENTION

Slab and tile cutting machines of the type referred to at the beginning are known in a wide variety of different forms. Cutting machines of this type generally have a frame which has a bearing surface for the slabs or tiles to be cut. A cutting member is generally mounted displaceably over the bearing surface on one or two guiding rails, which are fastened to the frame. The cutting member often comprises a carbide tip, which is rolled under pressure over the surface of the slab or tile to be cut. Arranged for this purpose in the region of the cutting member is a lever, with which first of all the cutting member can be pivoted about an axis parallel to the bearing surface, but with which also the necessary applied pressure for the carbide tip is produced.

Cutting devices of this type are designed only for straight cuts. To create curved borders on tiles, the person laying the tiles must use other means.

SUMMARY OF THE INVENTION

The invention is based on the object of providing a device for cutting slabs or tiles which can be used in a more versatile way.

This object is achieved by a tile cutting device, with a frame which has a bearing surface for tiles and also a cutting member for creating a rupture location in the tile surface, which member is mounted on the frame displaceably over the bearing surface by guides, and is provided with a lever with which the cutting member can be manually pivoted about an axis parallel to the bearing surface to create the necessary applied pressure. The guides for guiding the cutting member along a curved path comprise a mounting of the cutting member that is linearly displaceable in two directions comprising two parallel running rails, to which a running carriage is attached in each case. The running carriages are fixedly connected to each other by a further running rail, to which the cutting member is attached displaceably along the further running rail.

Advantageous and expedient developments of the device according to the invention are specified in the subclaims.

The invention is based on a tile cutting device with a frame which has a bearing surface for the tiles and is equipped with a cutting member for creating a rupture location in the tile surface, which member is mounted on the frame displaceably over the bearing surface by a guiding device, and is provided with a lever with which the cutting member can be manually pivoted about an axis parallel to the bearing surface to create the necessary applied pressure. The essence of the invention is that the guiding device for guiding the cutting member along a curved path during the displacement on the frame comprises a linearly displaceable mounting of the cutting member in two directions along the frame. The mounting includes two parallel running rails, to which a running carriage is attached in each case, the running carriages being fixedly connected to each other by a further running rail, to which the cutting member is displaceably attached. This makes it possible to create curved borders on slabs or tiles in a way corresponding to the guidance of the cutting member. This allows, for example, tile-laying work in the floor region of rooms with curved, for example half-round, wall sections to be carried out more efficiently and exactly, in that, during the cutting of the respective tile, the cutting member guide runs on a curved path which corresponds to the shape of the wall bounding the floor to be tiled. Until now, work of this type had to be carried out entirely manually, i.e. the tile was appropriately cut off with cutting tools guided by hand or the desired curved shape was broken out with nippers. It is easy to appreciate that exact tile edges cannot be produced by these methods. With the device according to the invention, on the other hand, the guidance of the cutting member by the guiding device allows exact tile edges to be created.

German Patent document 1 240 241 describes a device for cutting panes of glass in accordance with templates, which has at least one carriage for a cutting tool received by a tool holder. The cutting tool is movable with the aid of a drive under guidance by the template along two orthogonal coordinates given by fixed and movable rails, which also extend transversely in relation to one another. Each tool holder provided with a cutting tool is arranged on its own carriage and each carriage is driven movably for its part on a rail assigned to it and also with a guiding roller acting on the template. This device is designed quite specifically for the problems encountered in the exact cutting of panes of glass and is not suitable for the cutting of tiles.

It is also advantageous if the guiding device has a guiding template with a stop which extends in a way corresponding to the desired curved path and by means of which the cutting member is guided. For example, the cutting member may bear directly against the stop during displacement.

In an alternative configuration of the invention, the cutting member is guided directly on a guiding template which comprises at least one guiding unit shaped in the desired curved path, preferably a guiding or running rail. This measure makes it possible to dispense with additional guides, such as for example linear guides. This makes the construction simple and inexpensive.

To achieve guidance of the cutting member which is as simple but effective as possible, it is also proposed that the guiding device comprise a guiding template, in which the desired curved path is formed in the manner of slits.

It is also preferred if the guiding template can be arranged over the bearing surface, so that the cutting member can be guided like a stylus in the curved path formed in the manner of slits.

In an advantageous embodiment, it is also preferred if the cutting member is mounted rotatably about its longitudinal axis, i.e., with the cutting member placed on a tile or slab, about an axis which runs essentially perpendicularly with respect to the slab or tile surface to be cut. This creates the possibility of always aligning the cutting member in the direction of the path. This is advantageous in particular whenever a carbide wheel is used for creating a rupture location in the slab or tile surface, it being possible for said wheel always to roll along the curved path.

In a further advantageous configuration of the invention, the cutting member has in the guiding region of the guiding template a surface-contact bearing location, for example a square or rectangular cross section. In particular in the case of a slit-like guiding slot, the cutting member which bears with surface contact against the guiding slot, at least on one side, is in this way aligned automatically into the respective direction of the path in the manner of positive guidance. It can consequently be ensured that, for example, a carbide wheel on the cutting member used for the cutting rolls along in the direction of the path without any lateral sliding movement.

For the cutting device to be easy to handle, it is also advantageous if the guiding template is attached to the frame in such a way that it can be swung up above the bearing surface. This allows a tile to be easily put in place and aligned.

Finally, it is preferred if the guiding template is exchangeable. This is because it will be advantageous for an efficient working procedure to supply the cutting device together with a large number of commonly used guiding templates, which can be inserted into the device as required.

BRIEF DESCRIPTION OF THE DRAWINGS

Several exemplary embodiments of the invention are represented in the drawings and explained more precisely, with further details and advantages being specified.

DETAILED DESCRIPTION OF THE DRAWINGS

Figure 1:
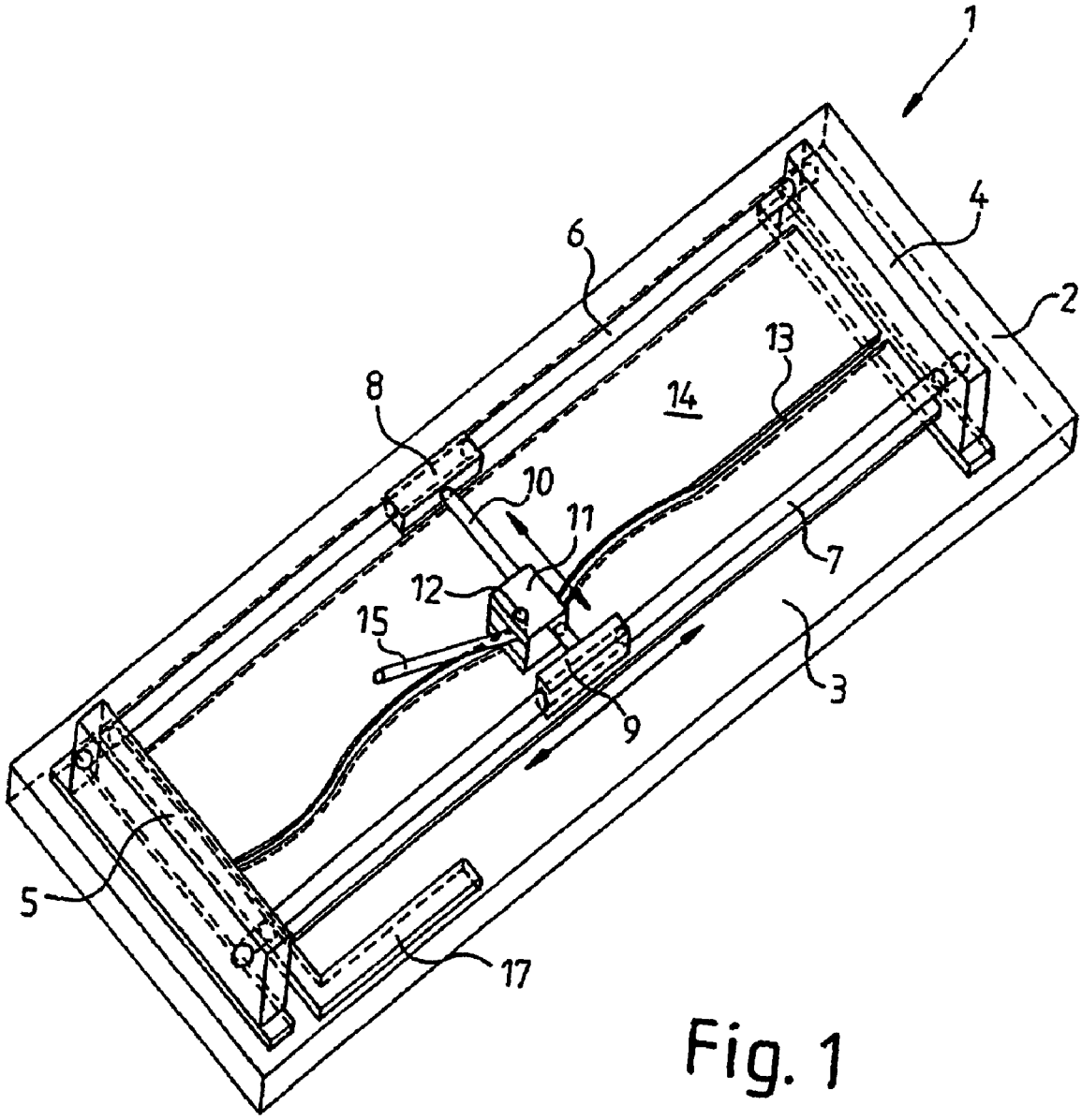
FIG. 1 shows a cutting device according to the invention in a perspective view.
Figure 2:
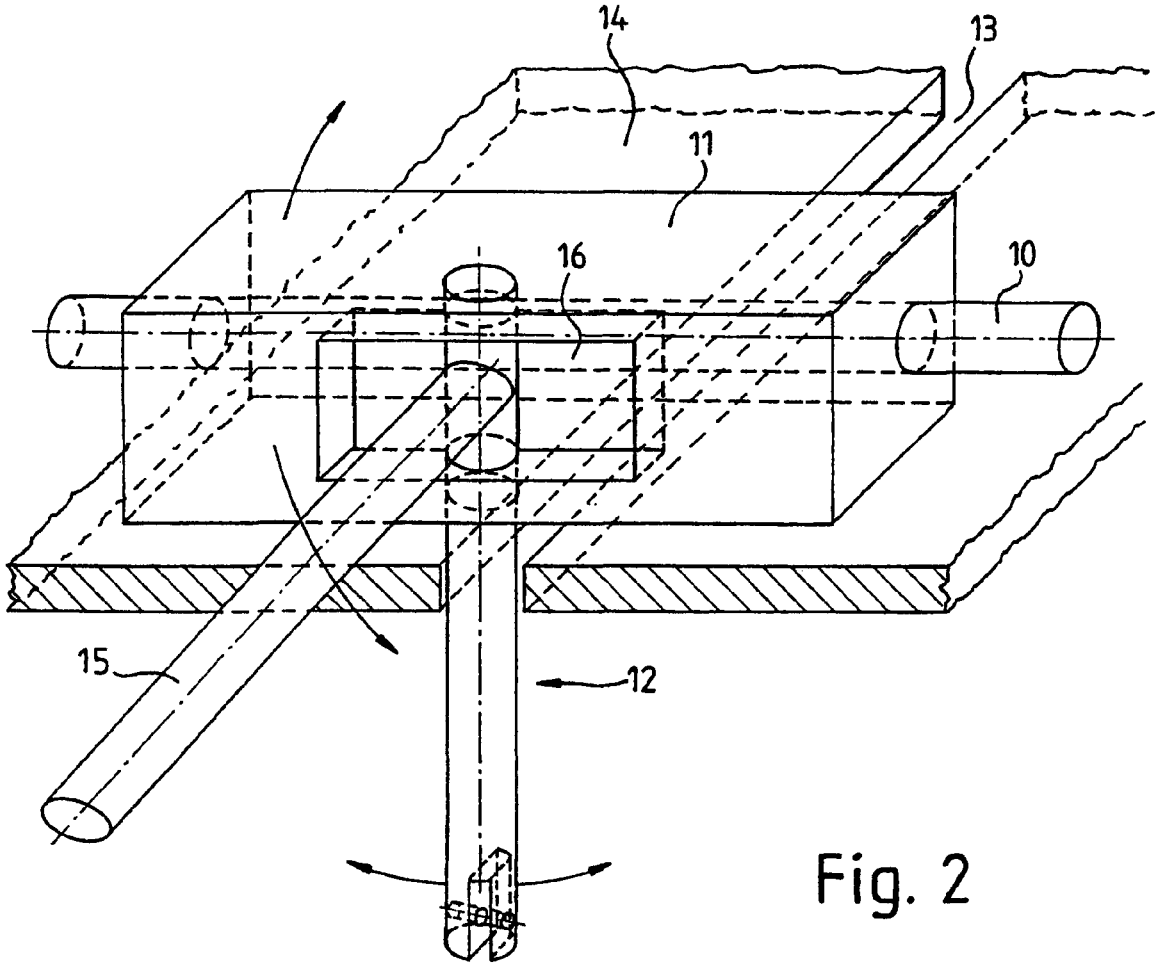
FIG. 2 shows a detailed cutout of the cutting device according to FIG. 1 in a perspective view.

The cutting device 1 represented in FIGS. 1 and 2 comprises a frame 2 with a bearing surface 3 for slabs or tiles. Arranged on the frame 2 are two vertically aligned bearing blocks 4, 5 for the securement of two running rails 6, 7 aligned in parallel. Displaceably attached to the parallel running rails 6, 7 are two running carriages 8, 9, which are fixedly connected to each other by a further running rail 10. Likewise displaceably attached to the running rail 10 is a receiving unit 11 for a cutting member 12 (see also FIG. 2). A portion of the cutting member 12 is located in a guiding slot 13 of a guiding template 14. The guiding slot has a curved shape, which corresponds to a desired tile border.

When there is movement of the running carriages 8, 9 along the parallel running rails 6, 7, the receiving unit 11 with the cutting member 12 arranged on it will carry out a movement on the running rail 10 in a way corresponding to the profile of the guiding slot.

The cutting member 12 is preferably mounted rotatably about its longitudinal axis in the receiving unit 11, so that for example a carbide wheel used for the cutting can be aligned in the direction of the path, i.e. tangentially in relation to the guiding slot.

To allow the cutting member to be pressed onto a tile to be cut and aligned if required along the guiding slot, a lever 15 which is fastened directly to the cutting member 12 is provided. By means of the lever 15, the complete receiving unit with the cutting member 12 can also be swung about the axis of the preferably bar-shaped running rail 10, for insertion or removal from the guiding slot 13.

To allow the lever 15 to be used for turning the cutting member 12 in its longitudinal axis (see double-headed arrows at the lower end of the cutting member 12), a recess 16 is provided in the receiving unit 11 for a lateral freedom of movement of the lever 15.

The cutting member 12 is preferably height-adjustable in the longitudinal direction in the receiving unit 11, so that a perpendicular alignment of the cutting member 12 in relation to a slab or tile surface in the state in which it has been placed onto the surface is permitted irrespective of the height of the tile or slab to be cut.

Furthermore, the guiding template 14 can preferably also be adjusted in height on the frame 2 for adaptation to different slab or tile heights.

It is also favorable if the unit comprising the bearing blocks 4, 5 with running rails 6, 7 together with the guiding template 14 can be swung up about an axis perpendicular to the running rails 6, 7 and parallel to the bearing surface 3. In this way, slabs or tiles can be placed into the cutting device 1 in a particularly simple way.

Furthermore, it is of advantage if a stop or an angle element] 17 is attached to the frame 2 for the simple positioning of a slab or tile to be cut.

Schematically represented in FIG. 2 is a cutting member which is equipped at its front end with a small carbide wheel (not represented). It is also conceivable, however, to use a scribing pin, with for example a carbide or diamond tip, instead of such a cutting member.

Figure 3:
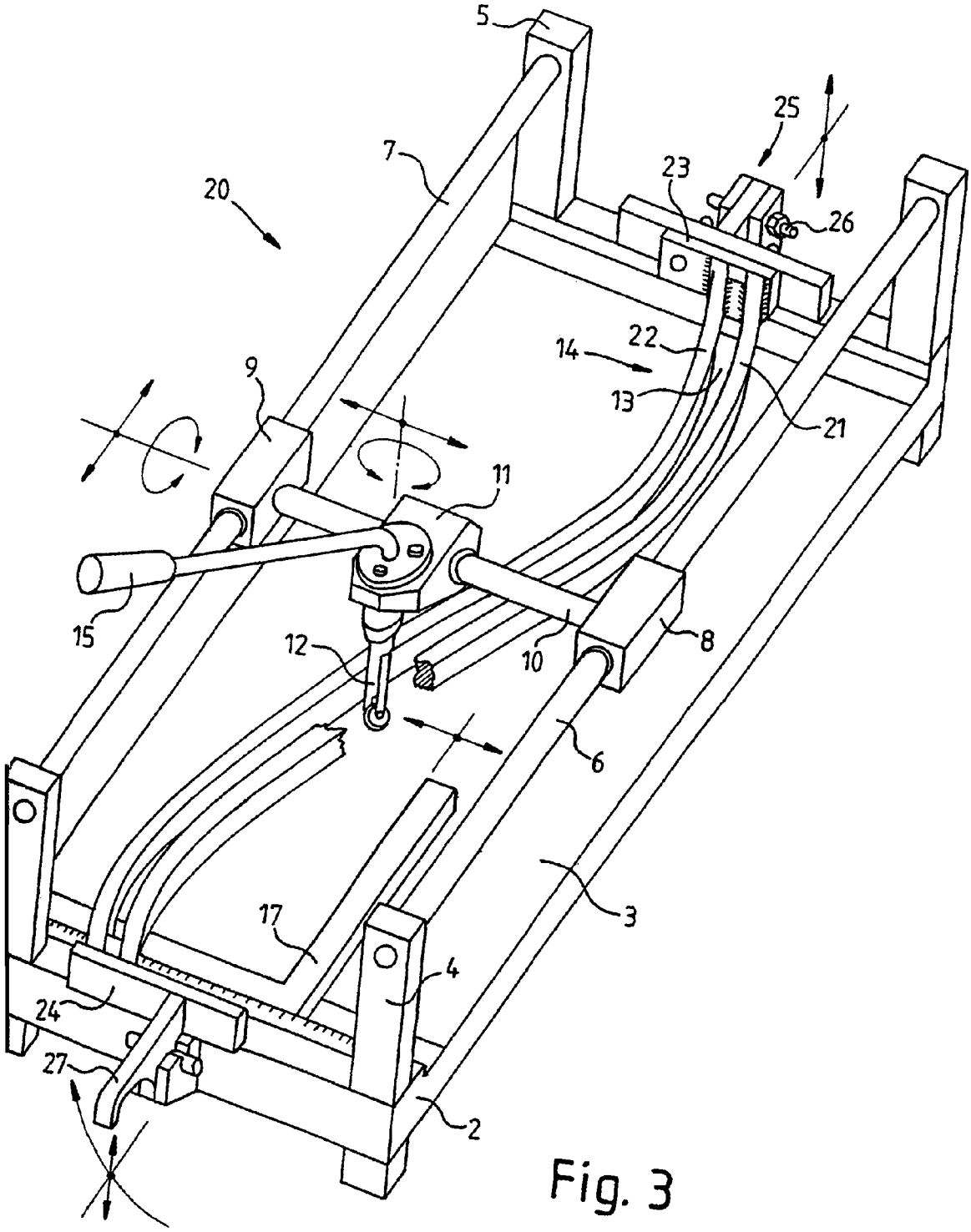
FIG. 3 shows a second cutting device in a perspective view, in which the guiding template comprises two running rails bent in parallel.

Represented in FIG. 3 is a cutting device 20 which is constructed in a similar way to the cutting device 1 according to FIG. 1. Therefore, similar components are provided with the same designations. A difference from the cutting device according to FIG. 1 is that the guiding template 14 comprises two running rails 21, 22 which are arranged parallel to and at a distance from each other and between which the cutting member 12 can be moved in a guided manner in the guiding slot 13.

The guiding rails 21, 22 are fastened, for example welded, onto holding plates 23, 24. The unit formed in this way can be swung up on the device 20 by means of a hinge 25 with a pivot axis 26 for free access to the bearing surface 3. On the side of the running rails 21, 22 opposite the hinge 25, an actuating lever 27 is provided, preferably with an arresting capability.

Furthermore, the mounting of the cutting member 12 in the receiving unit 11 is such that the lever 15 is not arranged within the receiving unit 11, as in FIG. 1, but above it. This type of arrangement of the lever 15 can be realized in a comparatively simpler way, and consequently at lower cost.

Figure 4:
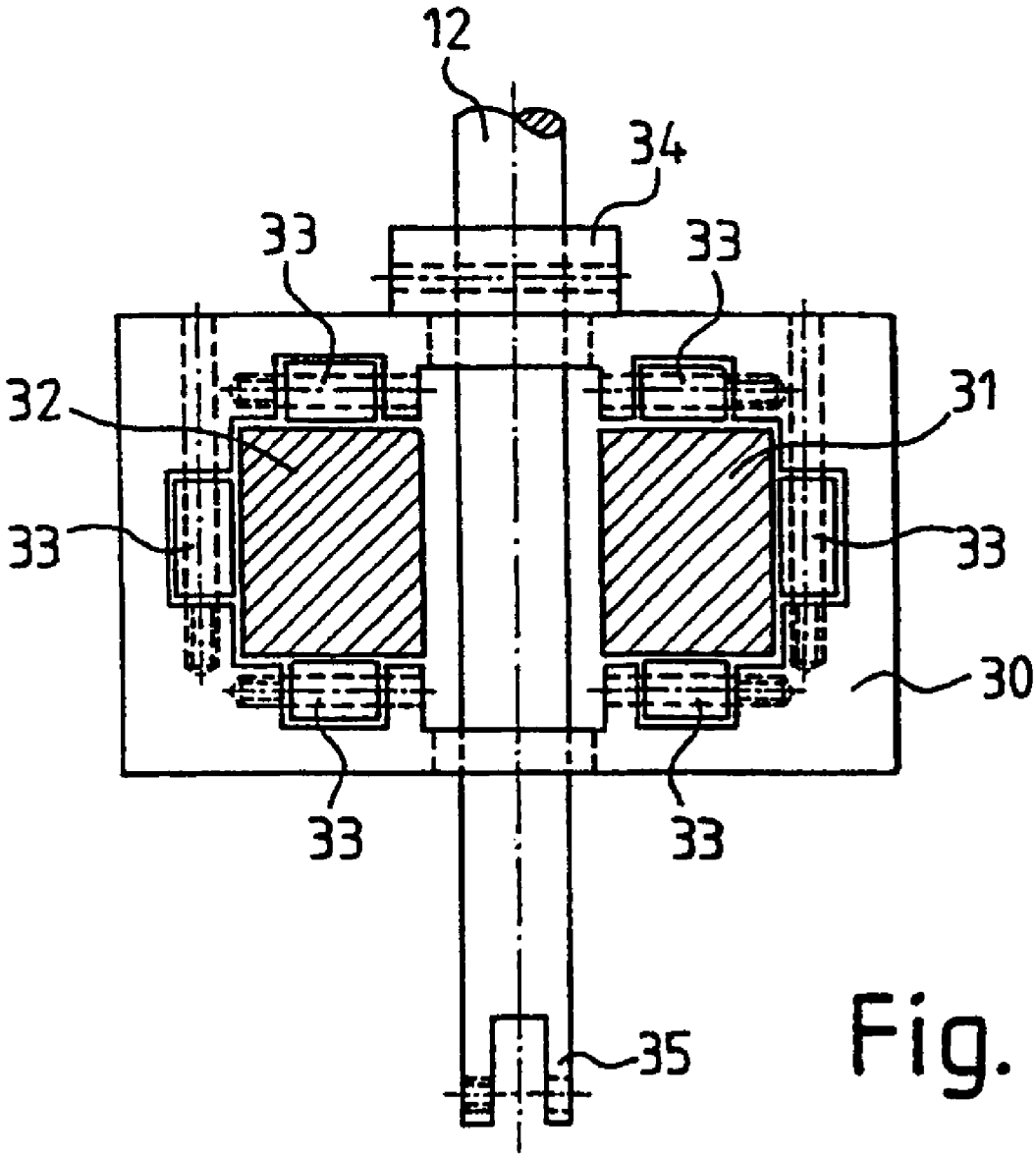
FIG. 4 shows a variant of the guidance of a cutting member on a guiding template in the form of a rail in a partially sectioned front view.

FIG. 4 shows a variant of the guidance of the cutting member 12. In this case, it is possible to dispense with running rails 6, 7, 10 and running carriages 8, 9, since a receiving unit 30 for the cutting member 12 is guided directly on running rails 31, 32, which run in parallel, are bent in the desired curved shape and correspond to the running rails 21, 22. To ensure easy mobility on the running rails 31, 32 and 21, 22, running rollers 33 are arranged in the receiving unit 30, preferably laterally and in the region of the upper side of the running rails.

The cutting member 12 may be mounted rotatably in its longitudinal axis in the block-like receiving unit 30 or be fixedly positioned by means of a holding element 34. The fixed arrangement may be advantageous in particular whenever the cutting member is equipped at its front end 35 with a carbide wheel and, consequently, exact guidance along the guiding rails can be ensured.

Figure 5:
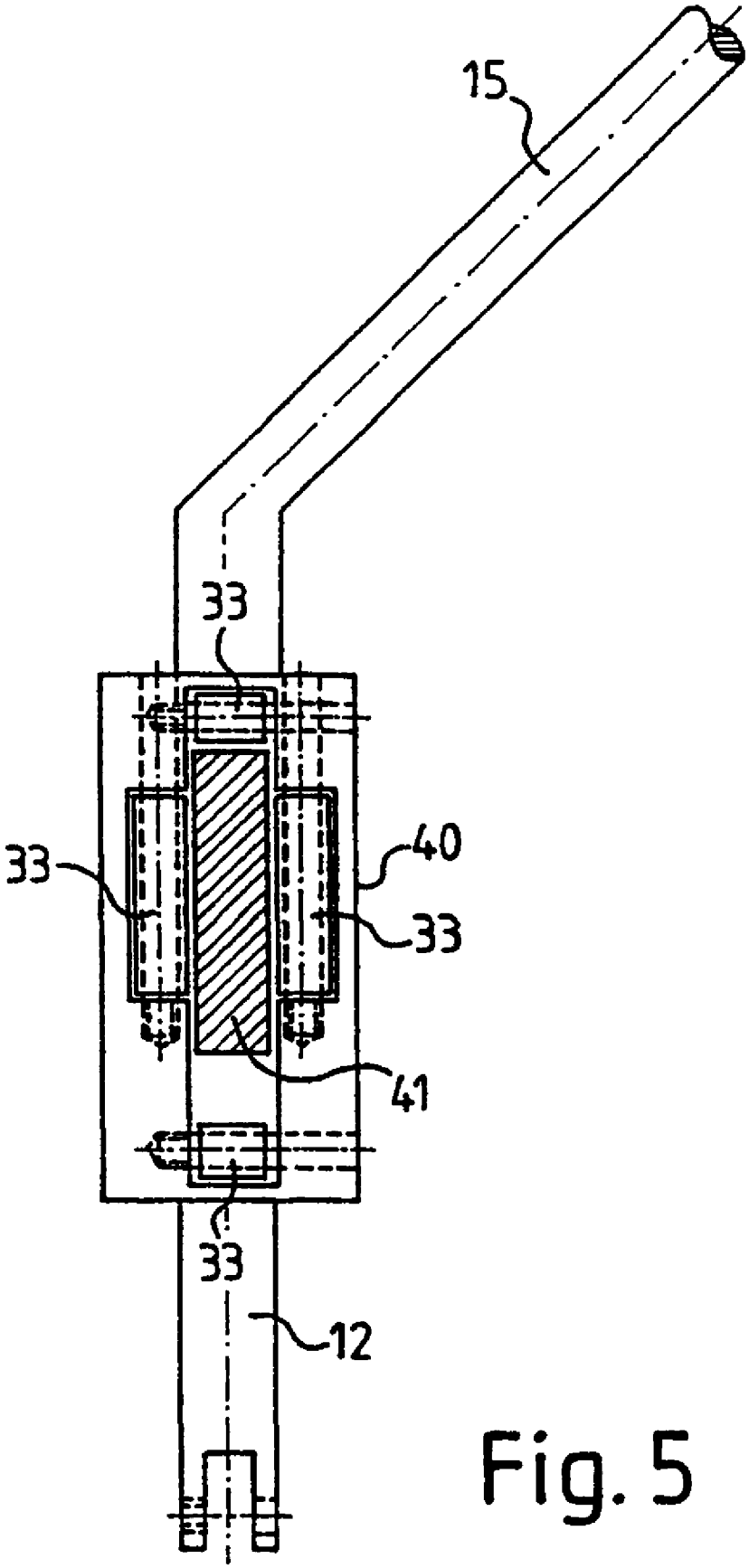
FIG. 5 shows a further variant of the guidance of a cutting member along a guiding template in the form of a rail in a likewise partially sectioned front view.

In FIG. 5, a variant of the template guidance according to] FIG. 4 is represented. In this configuration, the guidance of a receiving unit 40 does not take place on two parallel-running running rails 31, 32, as in FIG. 4, but on only one guiding rail 41, which has a desired curved path. The cutting member 12 is preferably fixedly arranged in the receiving unit 40. For easy displaceability of the receiving unit 40 on the guiding rail 41, running rollers 33 are likewise provided in the receiving unit 40. As in the other exemplary embodiments, the cutting member 12 can be moved on the receiving unit 40 by means of a lever 15 (not represented in FIG. 4).

TABLE OF DESIGNATIONS

1 Cutting device
2 Frame
3 Bearing surface
4 Bearing block
5 Bearing block
6 Running rail
7 Running rail
8 Running carriage
9 Running carriage
10 Running rail
11 Receiving unit
12 Cutting member
13 Guiding slot
14 Guiding template
15 Lever
16 Recess
17 Angle element
20 Cutting device
21 Running rail
22 Running rail
23 Holding plate
24 Holding plate
25 Hinge
26 Pivot axis
27 Actuating lever
30 Receiving unit
31 Running rail
32 Running rail
33 Running roller
34 Holding element
35 Front end
40 Receiving unit
41 Guiding or running rail

What is claimed:

1. A cutting device, comprising:

a frame having a bearing surface for tiles;

a cutting member displaceably mounted on the frame over the bearing surface, said cutting member having a lever with which the cutting member is manually pivotable about an axis parallel to the bearing surface to apply a pressure for creating a rupture location in the tile surface;

a guiding device for guiding the cutting member along a curved path, said guiding device comprising a mount for the cutting member that is linearly displaceable in two directions, said mount including two parallel running rails to which a running carriage is attached in each case, said running carriages being fixedly connected to each other by a further running rail, and said cutting member being displaceably attached along the further running rail.

2. The tile cutting device according to claim 1, wherein the guiding device further comprises a guiding template having a stop that extends in correspondence to a desired curved path and by which the cutting member is guided.

3. The tile cutting device according to claim 2, wherein in the guiding template the desired curved path is formed as a slit.

4. The tile cutting device according to claim 2, wherein said cutting member has in a guiding region of the guiding template a surface-contact bearing location.

5. The tile cutting device according to claim 4, wherein the guiding template is attached such that it is pivotable over the bearing surface.

6. The tile cutting device according to claim 2, wherein the guiding template is attached such that it is pivotable over the bearing surface.

7. The tile cutting device according to claim 2, wherein the guiding template is exchangeable in the tile cutting device.

8. The tile cutting device according to claim 3, wherein the guiding template is arrangeable over the bearing surface.

9. The tile cutting device according to claim 3, wherein said cutting member is guidable as a stylus in the guiding template having the desired curved path formed as a slit.

10. The tile cutting device according to claim 9, wherein said cutting member has in a guiding region of the guiding template a surface-contact bearing location.

11. The tile cutting device according to claim 9, wherein the guiding template is attached such that it is pivotable over the bearing surface.

12. The tile cutting device according to claim 3, wherein said cutting member has in a guiding region of the guiding template a surface-contact bearing location.

13. The tile cutting device according to claim 3, wherein the guiding template is attached such that it is pivotable over the bearing surface.

14. The tile cutting device according to claim 2, wherein the guiding template is arrangeable over the bearing surface.

15. The tile cutting device according to claim 14, wherein said cutting member is guidable as a stylus in the guiding template having the desired curved path formed as a slit.

16. The tile cutting device according to claim 14, wherein said cutting member has in a guiding region of the guiding template a surface-contact bearing location.

17. The tile cutting device according to claim 1, wherein the cutting member is guided directly and exclusively on a guiding template, said guiding template comprising at least one guide unit shaped in the form of the desired curved path.

18. The tile cutting device according to claim 17, wherein said at least one guide unit is one of a guide and running rail.

19. The tile cutting device according to claim 17, wherein the guiding template is arrangeable over the bearing surface.

20. The tile cutting device according to claim 17, wherein the guiding template is attached such that it is pivotable over the bearing surface.

21. The tile cutting device according to claim 1, wherein said cutting member is mounted rotatably about its longitudinal axis.

* * * * *